United States Patent [19]

Jones

[11] 4,055,854

[45] Nov. 1, 1977

[54] VERSATILE STRETCH KNIT GARMENT

[76] Inventor: Nathaniel P. Jones, Stuhr Garden Apartments, Apartment 7B, Frost Lane, Peekskill, N.Y. 10566

[21] Appl. No.: 761,620

[22] Filed: Jan. 24, 1977

[51] Int. Cl.[2] ..... A41D 1/22

[52] U.S. Cl. ..... 2/105

[58] Field of Search ..... 2/105, 106, 243 B, 69.5, 2/69, 74, 75, 67, 72

[56] References Cited

U.S. PATENT DOCUMENTS 3,473,167 10/1969 Jeffrey ..... 2/106

FOREIGN PATENT DOCUMENTS 2,460,048 6/1976 Germany ..... 2/105

*Primary Examiner*—Werner H. Schroeder
*Assistant Examiner*—Doris L. Troutman
*Attorney, Agent, or Firm*—Curtis Ailes

[57] ABSTRACT

The garment can be worn in any one of many different ways and is especially adaptable to cover the upper torso of the wearer as a halter-like garment. The garment includes a substantially flat double stretch knit body including a base portion and two separate upstanding portions formed integrally with the base portion, the upstanding portions diverging away from the center line of the body at the upper end thereof.

10 Claims, 11 Drawing Figures

FIG. 4
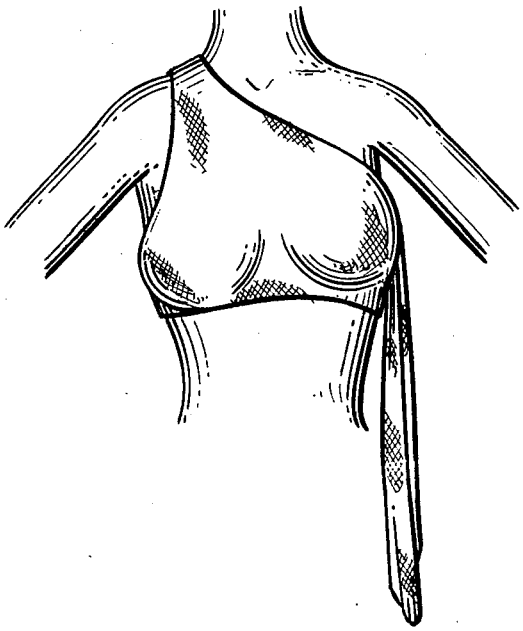
FIG. 5
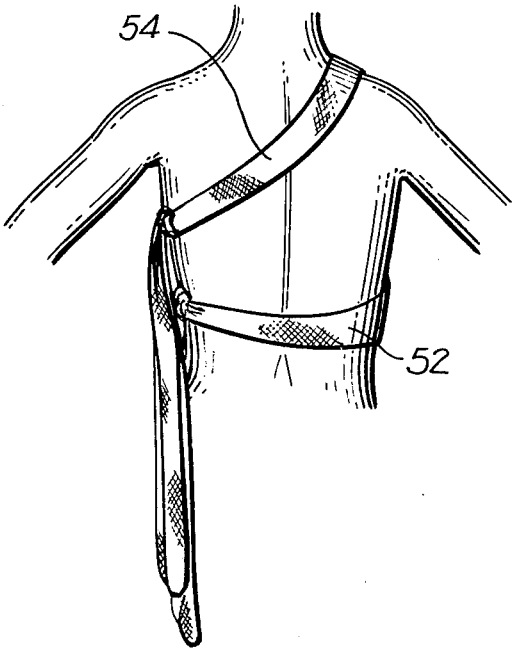
FIG. 6
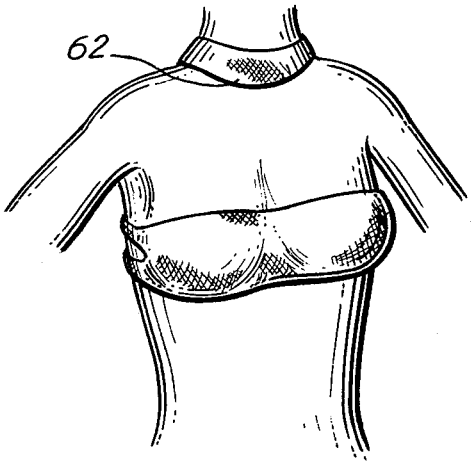
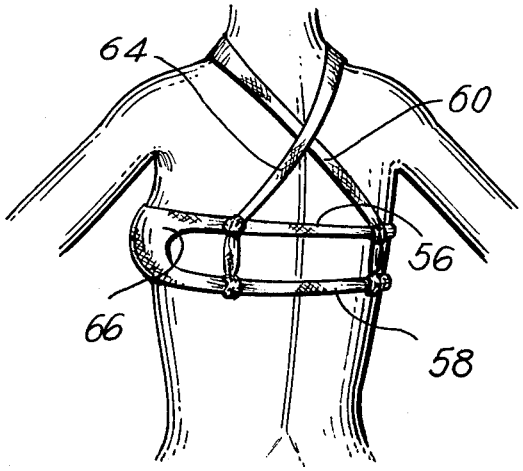
FIG. 7

VERSATILE STRETCH KNIT GARMENT

The present invention relates to a stretch knit garment which is especially adapted to be worn as a halter-like garment.

Halter-like garments for women, especially for summer wear, have been very popular. However, most such garments are capable of being worn in only one style, a style for which they are specifically designed.

It is an important object of the present invention to provide a garment which is especially attractive, and which is capable of being worn in many different configurations, without any alteration in the structure of the garment.

Another object of the invention is to provide a very attractive garment which can be worn in many different ways and which is very reasonable in cost.

Another object of the present invention is to provide a garment of the above description which may not only be worn in many different ways, but which may be worn in combination with other garments to serve many different functions such as a part of a play suit, a part of a bathing suit, or a part of a formal gown.

Other objects and advantages of the invention will be apparent from the following description and the accompanying drawings.

In carrying out the invention, there may be provided a versatile garment which is especially adapted to be worn as an item of brief female outerwear and which can be worn in many different ways to provide many different appearances comprising a structure which is substantially symmetrical about a center line including a substantially flat double stretch knit body including a base portion and two separate upstanding portions formed integrally with said base portion, said upstanding portions being substantially straight and equal in vertical length and diverging away from the center line at the upper ends thereof, said upstanding portions each being uniformly tapered to substantially a point at the upper end thereof, the unstretched length of said upstanding portions measured from the bottom of said base portion being more than 50 percent greater than the chest measurement of the intended wearer, and the unstretched basic width of said base portion being about equal to four tenths of said chest measurement, the material of said stretch knit body being capable of nondestructive elongation by stretching to a stretched dimension in the vertical longitudinal dimension along each of said upstanding portions to at least in the neighborhood of 1.4 times the corresponding unstretched dimension and to a stretched dimension horizontally across the base of said body portion to at least in the neighborhood of 1.7 times the corresponding unstretched dimension and said material being substantially opaque when stretched up to said stretched dimensions.

In the accompanying drawings:

FIGS. 2 – 11 are front and back views of different illustrative ways in which the garment of the invention may be worn.

Figure 1:
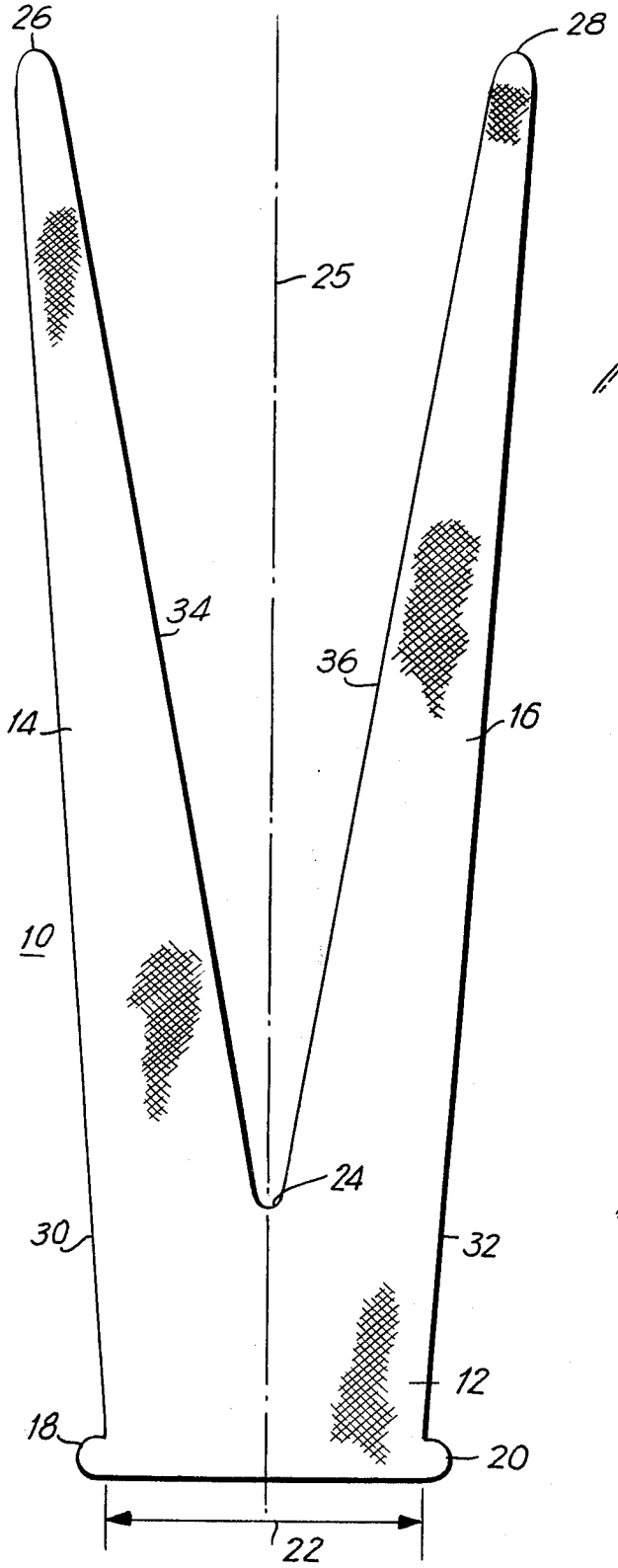
FIG. 1 is a plan view of a preferred embodiment of the invention.

Referring in particular to FIG. 1, the garment, which is designated as a whole as 10, is shown to be quite simple in structure, preferably being cut from a single thickness of double stretch knit material. The body includes a base portion 12 and two separate upstanding portions 14 and 16 which are preferably formed integrally with the base portion 12. At the bottom corners of the base portion 12 there are preferably provided integral laterally protruding tab portions 18 and 20 for the purpose of tying the garment on the wearer. The basic width of the base portion, at the bottom margin thereof, exclusive of the tabs 18 and 20, as indicated at 22, is preferably equal to about four tenths of the chest measurement of the intended wearer. The overall dimension from the bottom of the base portion to the top of each of the upstanding portions (which are preferably equal in length) is preferably more than fifty percent greater than the dimension corresponding to the chest measurement of the intended wearer, and more precisely, is preferably about 1.8 times that chest measurement.

The separation between the two upstanding portions 14 and 16 begins at a point indicated at 24, and this separation between the inside margins of the upstanding portions is preferably radiused for added strength and tear resistance.

The vertical dimension between the bottom edge of the base and the separation point 24 is preferably equal to about one-third of the chest measurement.

Using the above indicated proportions, for a nominal chest measurement of 31 inches, the width dimension 22 is 10 and ⅓ inches, the overall vertical dimension from top to bottom is 55.8 inches, and the vertical dimension from the bottom of the base to point 24 is 12.4 inches.

As illustrated in the drawing, the garment is substantially symmetrical about a center-line indicated at 25. The upstanding portions 14 and 16 are substantially straight and uniformly tapered to the upper tips 26 and 28 which are slightly rounded or blunted points. Each of the upstanding portions 14 and 16 is slanted away from the center-line 25 by approximately eight degrees. However, this angle is not very critical.

As indicated in the drawing, the outer side marginal edges of the garment, as indicated at 30 and 32, are preferably substantially uniformly tapered all the way from the bottom of the base portion, at the points from which dimension 22 is measured, to near the blunt tips 26 and 28. Similarly, the mutually facing marginal edges 34 and 36 of the upstanding portions are each substantially uniformly tapered from the point of separation 24 to near the blunt tips 26 and 28.

Figure 2:
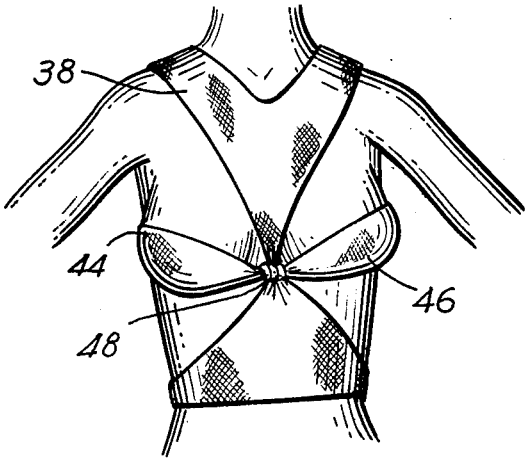
Figure 3:
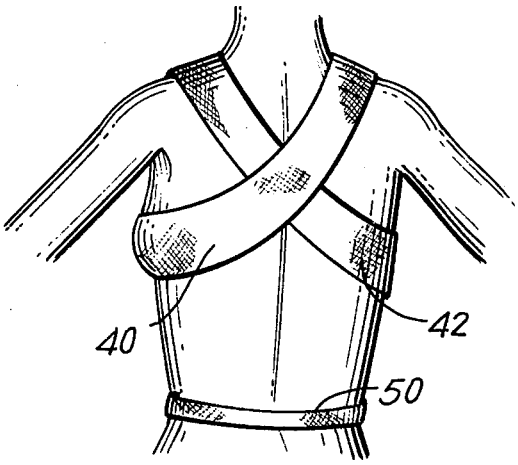

FIGS. 2 – 11 of the drawings illustrate a few of the many styles in which the garment of the present invention may be worn. The first of these styles is illustrated in FIGS. 2 and 3. FIG. 2 is a front view, and FIG. 3 is a back view of this style on a feminine torso.

Referring particularly to the style illustrated in FIGS. 2 and 3, the garment is put on in accordance with this style by placing the base portion of the garment over the chest of the wearer, as indicated at 38 in FIG. 2, with the bottom margin of the base portion extending downwardly, and then extending the separate upstanding portions over the respective shoulders of the wearer, crossing the upstanding portions over the back of the wearer, as indicated at 40 and 42 in FIG. 3, and then passing the ends of the upstanding portions under the arms of the wearer as also shown in FIG. 3. The upstanding portions are then stretched, if necessary, and are stretched across the breasts of the wearer, as shown at 44 and 46 in FIG. 2. The ends of the upstanding portions are then crossed around one another and reversed at the front center-point indicated at 48, and at the same time they are each caused to partially encircle the body portion at the point of crossing to gather the body portion into a narrow configuration at 48. Each of the upstanding portion ends are then passed down and around the waist of the wearer and each is then tied to an opposite bottom corner tab 18 or 20 at the bottom of the base portion. This final pass around the back of the wearer is indicated at 50 in FIG. 3.

A second style in which the garment may be worn is illustrated in FIGS. 4 and 5. In this style, the garment is first placed over the chest of the wearer with the base portion generally extending over the left breast of the wearer and with one of the upstanding portions extending over the right shoulder of the wearer and the other upstanding portion extending under the right arm of the wearer, as illustrated in FIG. 4. The last mentioned upstanding portion which extends under the right arm of the wearer is continued around the waist of the wearer, as shown at 52 in FIG. 5 and the free end of that upstanding portion is then tied to the entire base portion, causing the entire dimension 22 of FIG. 1 to be gathered together in that tie. The upstanding portion extending over the top of the right shoulder of the wearer is continued diagonally across the back of the wearer, as indicated at 54 in FIG. 5, and is tied to the free end of the other upstanding portion, and then the remaining free ends are left hanging as decorative tassels. This is an attractive one-strap arrangement, with the strap extending over the right shoulder. It will be understood that this style can be reversed to provide the strap over the left shoulder.

FIGS. 6 and 7 show a third illustrative style in which the garment of the invention may be worn. For this version of the invention, it is desirable to provide the garment with the maximum amount of stretch longitudinally of the upstanding portions, or to provide the garment with extra long upstanding portions.

First the base portion of the garment is placed crosswise across the breast of the wearer, with the bottom of the base portion to one side, such as the left side, and the upstanding portions to the other side, such as the right side. The two upstanding portions are then stretched around the back of the wearer, without crossing, (as shown at 56 and 58 in FIG. 7) and are respectively tied to the bottom corner tabs 18 and 20 of the base portion. The base portion of the garment thus extends across and covers the breasts of the wearer. The loose ends of the upstanding portions are then twisted together to form a single strap which is stretched across the back of the wearer as shown at 60, is extended around the neck of the wearer, as shown at 62 in FIG. 6, and then the two upstanding portions are again stretched across the opposite shoulder of the wearer and diagonally across the back, as indicated at 64, and individually tied, as indicated at 66, to the inner portions of the upstanding portions near to the point of joining with the base portion of the garment.

Figure 8:
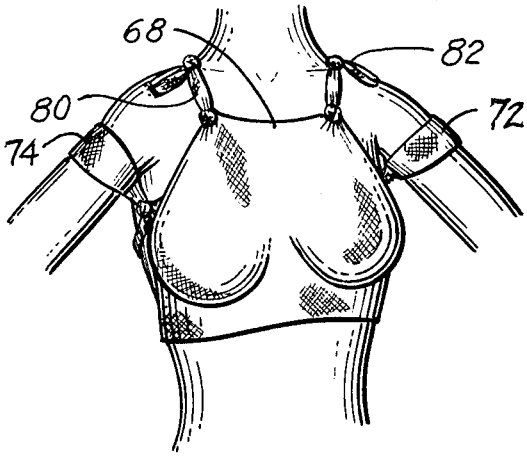
Figure 9:
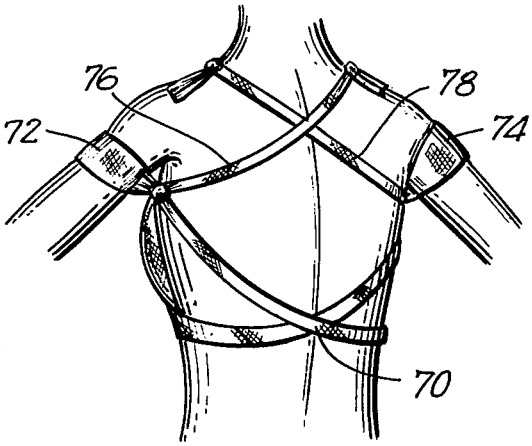

FIGS. 8 and 9 illustrate still another style in which the garment may be worn. In this style, the garment is first positioned upside down over the chest of the wearer, with the base portion just below the neck of the wearer, as indicated at 68. The base portion is then pulled down to cover the chest of the wearer and the two upstanding portions are stretched around the back of the wearer just above the waist level, are hooked around one another (at 70 in FIG. 9) at the middle of the back to reverse direction, and are then brought up under the respective arms of the wearer. At that point, the material at the sides of the base portion is pinched together, and the upstanding portion is tied to the base portion at the pinch at about the level of the nipples of the wearer. The remaining loose ends of the upstanding portions may then be wrapped around the back of the arm of each wearer, as indicated at 72 and 74 in FIG. 9. After wrapping completely around the arm of the wearer, the respective ends are stretched up across the upper back of the wearer, as indicated at 76 and 78 to cross over the opposite shoulders of the wearer and tied at the opposite corners of the bottom edge of the base portion of the garment (at tabs 18 and 20 of FIG. 1) as indicated at 80 and 82 in FIG. 8. Any remaining loose end can be tied in a decorative bow.

If desired, this style can be modified by omitting the loops 72 and 74 around the arms of the wearer, in which case the upstanding portions are carried directly from the ties at the nipple level across the upper back as indicated 76 and 78.

Figure 10:
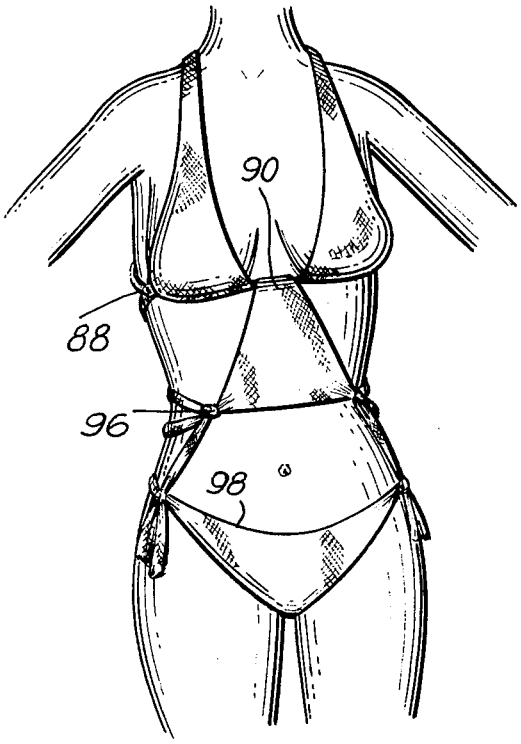
Figure 11:
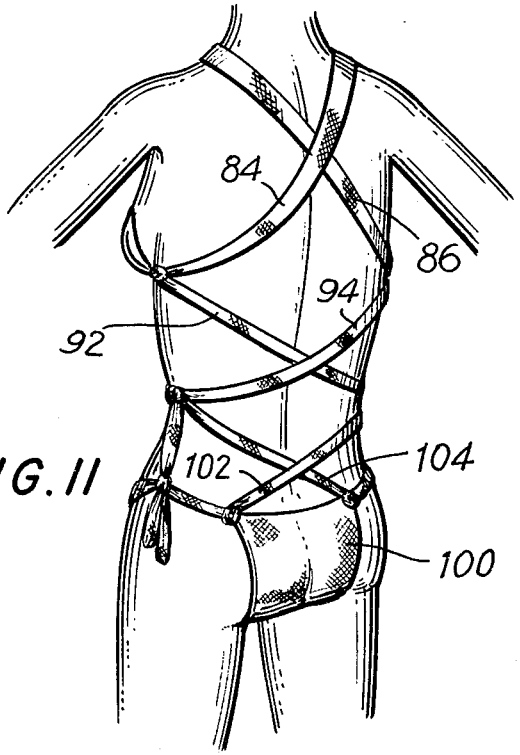

FIGS. 10 and 11 illustrate two different modes in which the garment of the present invention may be worn, including one bodice or halter version, and a bikini bottom version, the two being adaptable to being worn together as a brief bathing suit.

First, the top is put on by placing the garment over the chest of the wearer with the upstanding portions extending up over the shoulders of the wearer. The upstanding portions are then extended diagonally across the back of the wearer, as indicated at 84 and 86 in FIG. 11, and the side marginal edges of the body portion are pinched at a level opposite to the separation point 24 (refer to FIG. 1) between the two upstanding portions, and the wrapped around upstanding portions are then tied to the pinched portions of the side marginal edges, as indicated at 88 in FIG. 10, for instance. These ties are positioned under the arms of the wearer. After these ties are made, the bottom of the base portion is threaded up under the separation point 24 to provide a gathering of the base portion at a central point 90 in the front of the garment, and as indicated in FIG. 10. In order to accentuate this gathering action, the bottom of the base portion is twisted one-half turn after it is threaded through. The loose ends of the upstanding portions are then stretched across the small of the back of the wearer and crossed to the opposite sides, as indicated at 92 and 94 in FIG. 11, and tied to the bottom marginal corners 18 and 20 of the base portion, as indicated for instance at 96 in FIG. 10. The bodice or halter portion is thus complete. While this bodice or halter is illustrated as a part of a combination which forms a bathing suit, it can be used in other ways, such as for part of a play suit or of an evening wear ensemble.

In order to provide the bathing suit bottom, another one of the garments in accordance with the present invention is placed right side up in front of the wearer at a height just sufficient to cover the genital area, as indicated at 98 in FIG. 10, and the bottom of the base portion is then stretched under the crotch of the wearer and across the seat of the wearer in the rear, as indicated at 100 in FIG. 11. The upstanding portions are then stretched apart and across the hips of the wearer and tied to the tabs 18 and 20 respectively. This really completes the putting on of the garment as a bikini bottom. However, in order to provide even greater security and unity of the garment with the upper portion of the bathing suit, the loose ends of the upstanding portions are preferably extended respectively diagonally across the back of the wearer, as indicated at 102 and 104 in FIG. 11, and tied at the bottom corners of the base portion of the garment which formed the top of the bathing suit, as previously described above. This completes the assembly of the two garments to form a bathing suit.

While the arrangement of the garment as a bathing suit bottom has been described above in connection with the particular bodice arrangement illustrated in FIGS. 10 and 11, the bathing suit bottom version of the garment can be employed with any bodice arrangement.

The above arrangements of the garment illustrate only a few of the many possibilities for this versatile garment.

As indicated earlier, the body 10 of the garment is preferably composed of a double stretch knit material which need not necessarily have the same stretch properties in both dimensions. Thus, it is preferable to have a material which is capable of minimum non-destructive elongations by stretching to stretched dimensions which bear the following relationships to the original unstretched dimensions: horizontal (across the base) 1.7; and vertical (along the length of each upstanding portion) 1.4.

There are many different double stretch knit fabrics which may be successfully used in carrying out the present invention. Suitable fabrics of this nature are available from various manufacturers including Darlington Fabrics Corporation, 5101 Empire State Building, New York, N.Y. 10001, and Deering Milliken Inc., 1045 Sixth Ave., New York, N. Y. 10018. One specific fabric which has been found to give excellent results is Deering Milliken style 9120.

Generally, the results in carrying out the present invention are improved with improved stretchability of the fabric. An excellent constituent of the fabric for providing that stretchability is spandex, which includes a high percentage of stretchable polyurethane fibers. With fabrics which rely on a spandex content for stretchability, it has been found to be generally desirable to provide in the order of 20% or more of spandex.

In the above mentioned Deering Milliken style 9120 material, the spandex content is about 23%.

While this invention has been shown and described in connection with particular preferred embodiments, various alterations and modifications will occur to those skilled in the art. Accordingly, the following claims are intended to define the valid scope of this invention over the prior art, and to cover all changes and modifications falling within the true spirit and valid scope of this invention.

I claim:

1. A versatile garment which is especially adapted to be worn as an item of brief female outerwear and which can be worn in many different ways to provide many different appearances comprising a structure which is substantially symmetrical about a center-line including a substantially flat double stretch knit body including a base portion and two separate upstanding portions formed integrally with said base portion, said upstanding portions being substantially straight and equal in vertical length and diverging away from the center-line at the upper ends thereof, said upstanding portions each being uniformly tapered to substantially a point at the upper end thereof, the unstretched length of said upstanding portions measured from the bottom of said base portion being more than fifty percent greater than the chest measurement of the intended wearer, the unstretched basic width of said base portion being about equal to four tenths of said chest measurement, the separation between said upstanding portions beginning at a vertical dimension measured from the bottom of said base portion which is about equal to one third of said chest measurement when said garment is in the unstretched condition.

2. A garment as claimed in claim 1 wherein the fabric of said stretch knit body is capable of non-destructive elongation by stretching to a stretched dimension in the vertical longitudinal dimension along each of said upstanding portions to at least in the neighborhood of 1.4 times the corresponding unstreched dimension and to a stretched dimension horizontally across the base of said body portion to at least in the neighborhood of 1.7 times the corresponding unstretched dimension and said fabric being substantially opaque when stretched up to said stretched dimensions.

3. A garment as claimed in claim 2 wherein integral tabs in the form of lateral protrusions are provided at the bottom corners of said base portion for ease in typing the garment when the garment is worn.

4. A garment as claimed in claim 2 wherein the upper pointed ends of said upstanding portions are rounded to provide a blunted point.

5. A garment as claimed in claim 4 wherein said unstretched length of said upstanding portions is equal to about 1.8 times said chest measurement.

6. A garment as claimed in claim 5 wherein the fabric of the garment comprises at least 20% spandex.

7. A garment as claimed in claim 1 wherein the divergence of each of said upstanding portions away from the center-line is approximately eight degrees.

8. A garment as claimed in claim 4 wherein the side marginal edges of said knit body in the unstretched condition are substantially uniformly tapered from near the bottom of said base portion to near the blunted points of the tips of said respective upstanding portions.

9. A garment as claimed in claim 4 wherein the mutually facing marginal edges of the sides of said upstanding portions in the unstretched condition are each substantially uniformly tapered from said separation to near said blunted points at the upper ends of said upstanding portions.

10. A garment as claimed in claim 9 wherein the marginal edge of said body is radiused at said separation between said upstanding portions to provide additional strength.

* * * * *

UNITED STATES PATENT AND TRADEMARK OFFICE

CERTIFICATE OF CORRECTION

PATENT NO. : 4,055,854

DATED : November 1, 1977

INVENTOR(S) : NATHANIEL P. JONES

It is certified that error appears in the above-identified patent and that said Letters Patent are hereby corrected as shown below:

Column 4, line 18, after "indicated" insert --at--;
line 30, after "level" insert --about--.

Column 6, line 31, "typing" should read --tying--.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*